US009038337B2

(12) United States Patent
Portocarrero-Velasco

(10) Patent No.: US 9,038,337 B2
(45) Date of Patent: May 26, 2015

(54) REINFORCED CONCRETE HEXAHEDRAL MODULE

(71) Applicant: Alejandro. Portocarrero-Velasco, North Richland Hills, TX (US)

(72) Inventor: Alejandro. Portocarrero-Velasco, North Richland Hills, TX (US)

( * ) Notice: Subject to any disclaimer, the term of this patent is extended or adjusted under 35 U.S.C. 154(b) by 0 days.

(21) Appl. No.: 14/205,274

(22) Filed: Mar. 11, 2014

(65) Prior Publication Data

US 2014/0190114 A1 Jul. 10, 2014

(51) Int. Cl.

| | |
|---|---|
| ***E04B 1/04*** | (2006.01) |
| ***E04H 1/12*** | (2006.01) |
| ***E04B 1/34*** | (2006.01) |
| *E04B 1/00* | (2006.01) |

(52) U.S. Cl.

CPC ..... *E04H 1/1205* (2013.01); *E04B 1/04* (2013.01); *E04B 1/3412* (2013.01); *E04B 2001/0092* (2013.01)

(58) Field of Classification Search

CPC . E04B 1/04; E04B 1/3412; E04B 2001/0092; E04H 1/1205

USPC ..... 52/86, 649.2, 79.4, 236.1

See application file for complete search history.

(56) References Cited

U.S. PATENT DOCUMENTS

| | | | | |
|---|---|---|---|---|
| 3,152,366 | A * | 10/1964 | McCrory et al. | 52/79.4 |
| 3,600,865 | A * | 8/1971 | Vanich | 52/73 |
| 4,158,941 | A * | 6/1979 | Diana | 52/745.1 |
| 4,598,515 | A * | 7/1986 | Diana | 52/236.1 |
| 7,204,060 | B2 * | 4/2007 | Hunt | 52/284 |
| 7,963,072 | B2 * | 6/2011 | Anderson et al. | 52/82 |
| 8,763,326 | B2 * | 7/2014 | Takeshima | 52/236.1 |
| 2007/0056223 | A9 * | 3/2007 | Hunt | 52/79.1 |
| 2014/0190114 | A1 * | 7/2014 | Portocarrero-Velasco | 52/649.2 |

* cited by examiner

*Primary Examiner* — Andrew J Triggs

(57) ABSTRACT

The utility model discloses a monolithic reinforced concrete piece for the construction of buildings which is characterized for having six columns arrange in a hexagonal distribution, a continuous beam with variable depth supported by the columns making six spans and forming a hexagonal perimeter viewed from top, a corbel fixed along the beam's external face, and a roof which has a hexagonal shape with a circular hole in the center in plan view and cambered in the elevation view which rest on the continuous beam. In use the reinforced concrete hexahedral module can be cast-in-place or pre-cast and transported to its final position on the construction site and used as part of a building defining the space and ambience of said building. This invention has the advantage of being safe, strong and reliable, providing a fast new method of construction for different kinds of buildings.

4 Claims, 5 Drawing Sheets

REINFORCED CONCRETE HEXAHEDRAL MODULE

BACKGROUND OF THE INVENTION

The common methods for the construction create a huge variety of buildings where everybody can choose from according to their preferences and economic resources, but most important, this growing population now demands safer buildings because of extreme weather and/or natural forces. These events are a constant hazard to people's safety inside some kinds of buildings however, the requirements of strength are not enough, the interest in green buildings has grown over the past few years as well as developing new materials and techniques of construction that are safe, fast and eco friendly.

Typically the construction of buildings is a time consuming task, but the use of prefabricated elements reduces the times in construction, achieving lower costs however, wooden elements which are the most used do not fulfill the requirements of safety in every way. As technology develops over time, improvements in forming systems and insulation materials increased the easy and appeal of using removable forms for constructions, nowadays there are different kinds of building construction methods such as pre-fabricated and modular buildings using pre-cast or cast-in-place concrete elements. These constructions are stronger in most cases than their wood counterpart and they reduce to a minimum the need for timber. Their thermal property together with appropriate insulation makes concrete structures quite energy efficient furthermore, different kinds of finishes can be applied to the interior or exterior, giving to said constructions a more friendly appearance; however Portland cement which is the most common type of cement used throughout the world is far from being a green material, but cement substitutes and concrete alternatives are now available to assist in making concrete a truly green material, allowing users to enjoy the benefits of concrete without sacrificing their commitment to the environment.

SUMMARY OF THE INVENTION

The present invention relates to a reinforced concrete hexahedral module which is a monolithic piece to be used in the constructions of buildings and is used as a part of a building defining the space and ambience of said building (e.g. house, shelter or deposit). This invention provides a perimeter to build or install walls, a roof to protect the inside of the structure and a support to attach beams, slabs, trusses or others structural elements to the roof.

It is an object of this invention to provide a safe structure where the sizing and structural properties are designed according to the calculations and the judgment of the engineer, therefore, the steel reinforced can be placed properly to ensure a correct structural behavior.

It is an object of this invention to provide a fast and practical method of construction using this reinforced concrete piece as the principal element which fits between similar or other components from traditional construction, and also provide a new architectonic option which is different than the typical architecture.

This invention has all the benefits from a reinforced concrete piece that are widely known; strong elements, resistance against fire and strong winds and also resistance against molt, rot, mildew and insect. The concrete properties such as density, coefficient of thermal expansion and others, gives the structure sound blocking characteristics and the ability to be an insulated system, resulting in energy efficient, therefore cost savings.

This invention has the advantage of low construction cost due to the minimum workmanship required and the simplicity of the construction method, furthermore, the formwork used for this invention can give an extra time saving and the properties of the concrete can be modified to speed up the removal of the formwork.

DESCRIPTION OF THE DRAWINGS FIGURES

This invention features and advantages will appear more fully described in the description that follows in conjunction with the accompanying sheets of drawings. The object of the drawings is to be fully understood however, the drawings are for illustrative purposes due that the sizing and calculation of the reinforced concrete structure will define the final size for each project which may include different kinds of texture therefore, this invention might or might not retain the geometrical proportion exactly as these drawings.

FIG. 1 is an isometric view of the reinforced concrete hexahedral module showing all its components; six columns, the continuous beam which rest on the columns, the corbel fixed to the lateral face of the beam in all its length and the hexagonal roof which rest on the continuous beam.

FIG. 2 is the front elevation view of the reinforced concrete hexahedral module showing the columns, the continuous beam, the corbel and the hexagonal roof, the figure shows the beam going from the left front column to the right front column connecting in this pattern until the beam ends where it began, making six spans. This figure shows a better view for the variable depth of the beam, which is deeper at the point of connection with the columns and shallow at the middle span, and also shows the corbel fixed to the beam's lateral external face in all its length.

Figure 4:
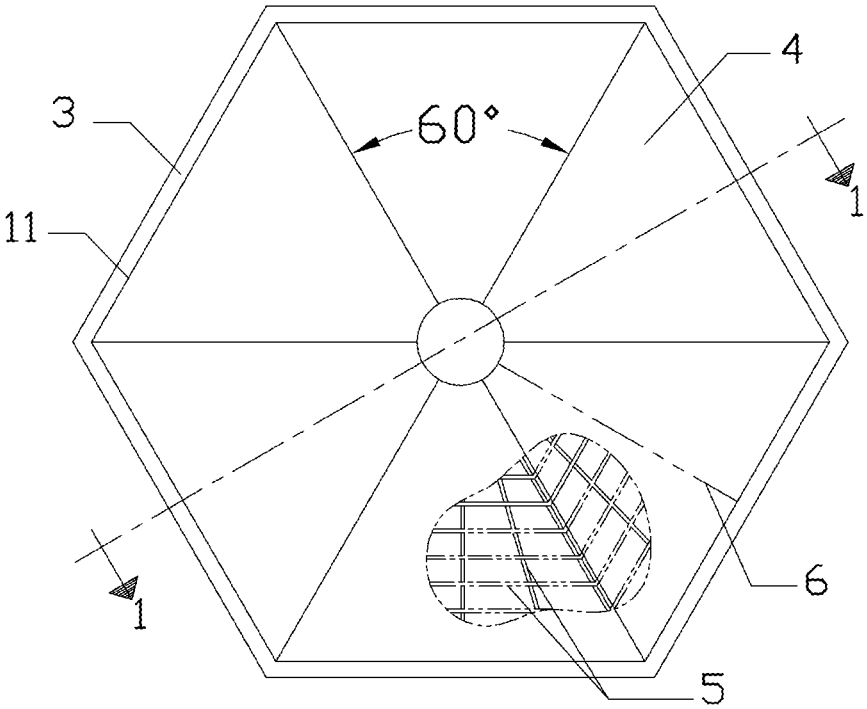
FIG. 4 is a plan view of the reinforced concrete hexahedral module showing the hexagonal roof and the corbel which is fixed to the beam's external face surrounding the entire roof. The steel reinforcement (seen inside the roof as a mat drawn in phantom line) may be placed in one or more layers according to the calculations done by the engineer.
Figure 5:
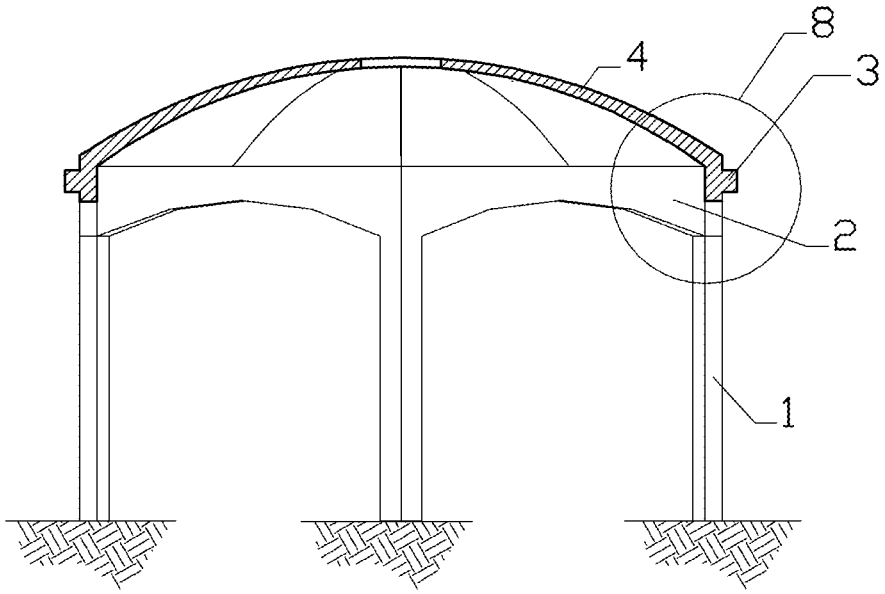

FIG. 5 is a cross-sectional view taken along lines 1-1 of FIG. 4 showing the variable thickness of the hexagonal roof which is thicker at the point of connection with the beam and thinner at the center of the structure, the variable cross section of the continuous beam, the cross section of the corbel which remains constant, and the width of the column which is the same as the beam's width. It also shows the detail area for FIG. 8.

Figure 2:
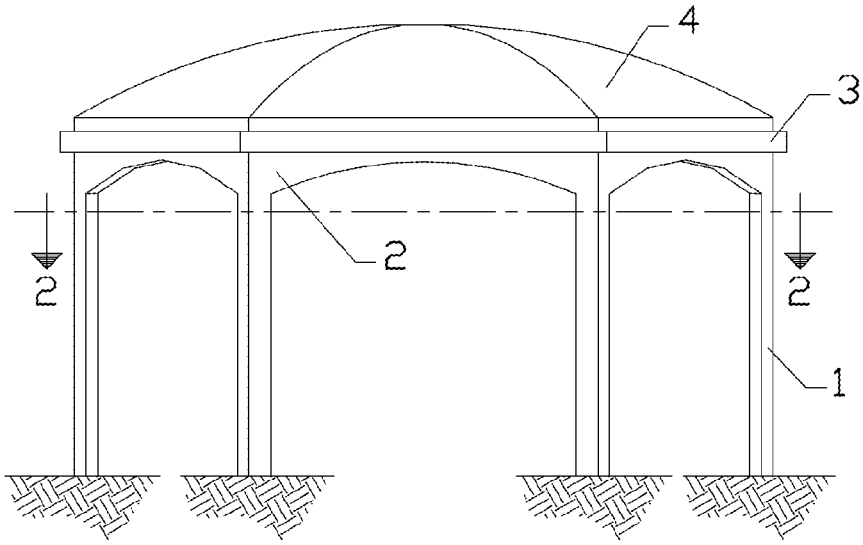
Figure 3:
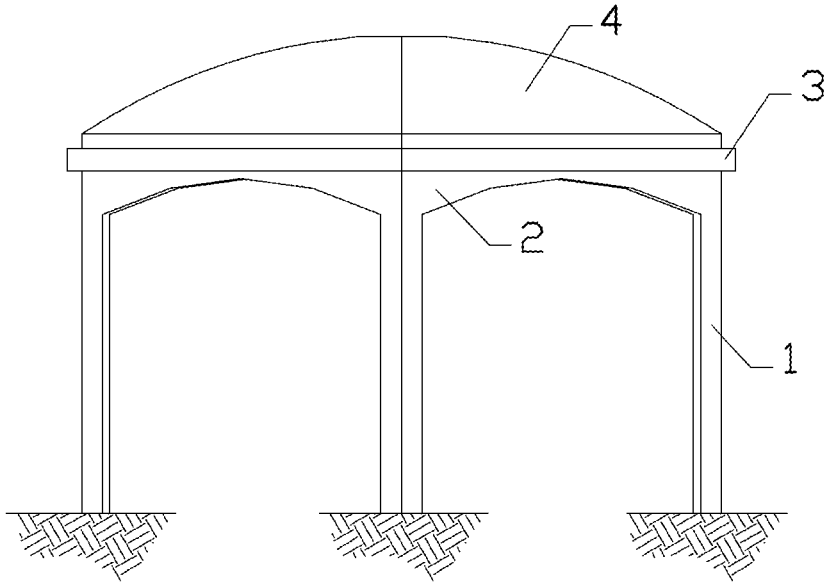
FIG. 3 is the lateral elevation view of the reinforced concrete hexahedral module showing the columns, continuous beam and the hexagonal roof; it also shows the corbel fixed to the beam's lateral external face in all its length such as the previous figure.
Figure 6:
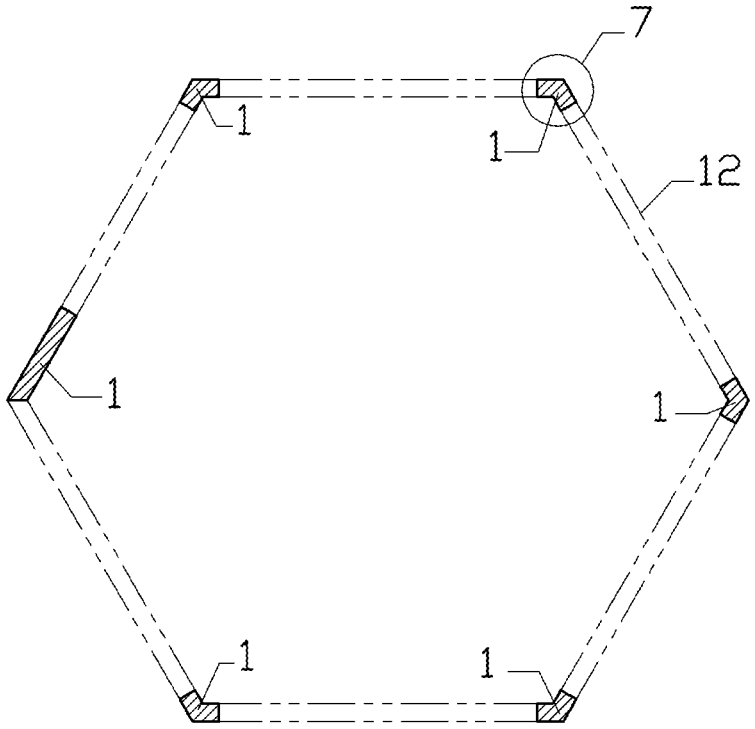

FIG. 6 is a cross-sectional view taken along lines 2-2 of FIG. 2 showing the cross section of the columns and their distribution in a hexagonal arrangement, contained in the beam's width which its vertical projection is shown in phantom line. It also shows the detail area for FIG. 7.

Figure 7:
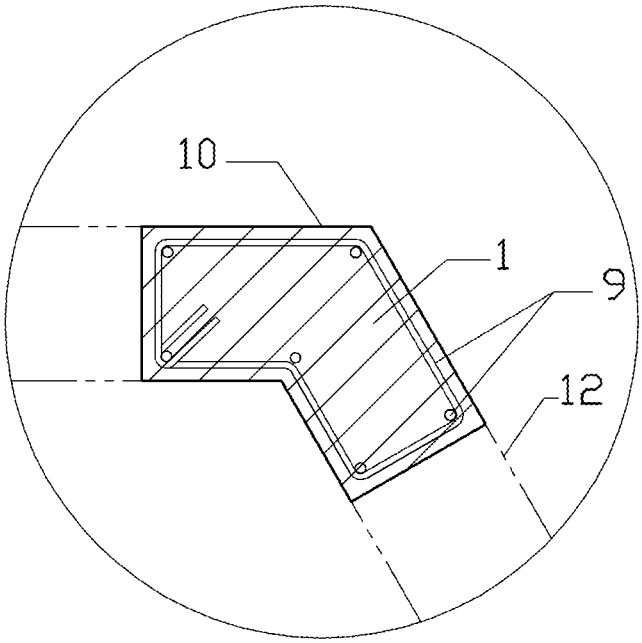

FIG. 7 is a detail view taken from FIG. 6. This drawing shows the cross section of one column contained in the continuous beam's width which its vertical projection is shown in phantom line. It also shows the steel reinforcement inside the columns which shall be placed longitudinal and across the column according to the calculations done by the engineer (the drawings for the steel reinforcement are only for illustrative purposes).

Figure 8:
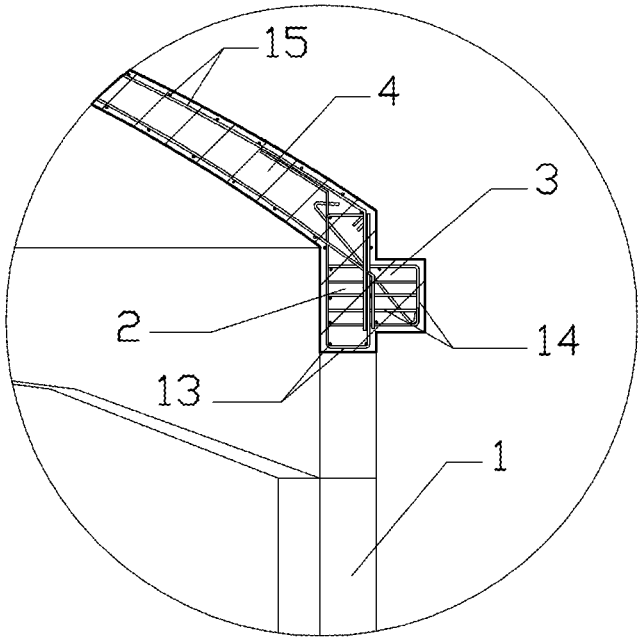

FIG. 8 is a detail view taken from FIG. 5. This drawing shows the cross section of the beam and corbel, and the partial cross section of the hexagonal roof It also shows the steel reinforcement Inside the beam, the corbel and the hexagonal roof, which shall be placed longitudinal and across these elements according to the calculations done by the engineer (the drawings for the steel reinforcement are only for illustrative purposes).

Figure 9:
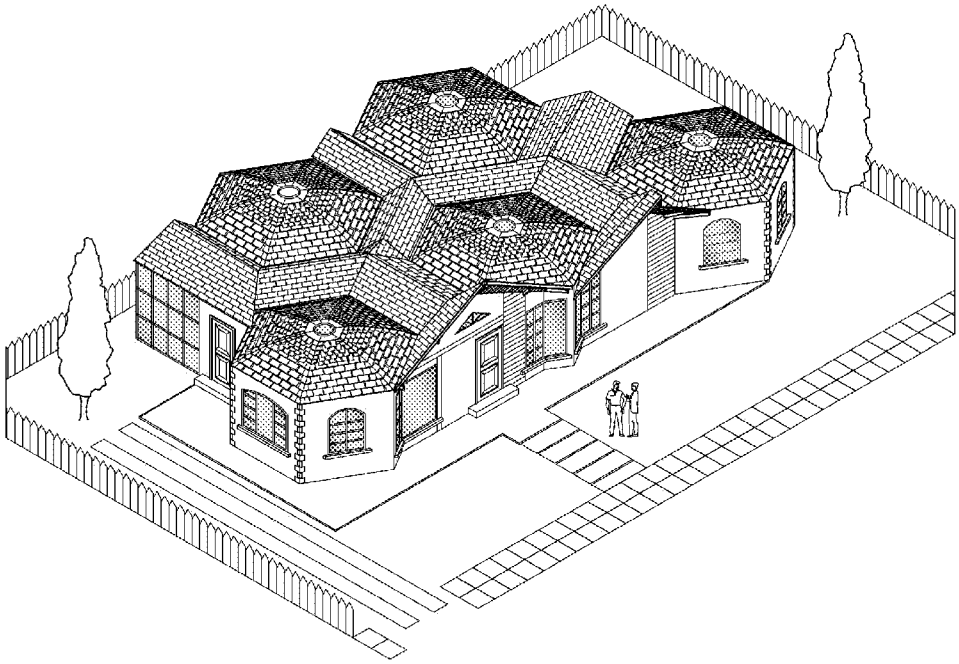

FIG. 9 is an isometric view from a house built using the reinforced concrete hexahedral module and shows how this invention combined with traditional construction elements looks.

DETAILED DESCRIPTION OF THE PREFERRED EMBODIMENT

The reinforced concrete hexahedral module, referring from FIGS. 1 to 9 is a reinforced concrete piece which can be cast-in-place or pre-cast and transported to its final position on, the construction site and fixed over a foundation defined by the engineer and the project scope. It is a new product and was developed as a new kind of construction element for different kinds of buildings, and is intended to be used as part of a building defining the space and ambience of said building. It can be dosed according the use, the geographic and environmental conditions, and the loads considered by the engineer.

The sizing of this invention may vary according to the calculation and the requirements of a given project. Given the complex geometry of this invention, the method of calculation for the stresses, forces, reactions, deflection and so on shall be performed through classical mathematical techniques, analytic mathematical modeling or computational simulation; for this last option, the structural analysis software shall be accurate and validated.

The design of the steel reinforcement shall use the latest edition of codes such as ACI-318, EHE, EUROCODE 2, or other as complete as these ones. The steel reinforcement shall be dimensioned and placed according to the resulting calculations of all adopted load cases.

Figure 1:
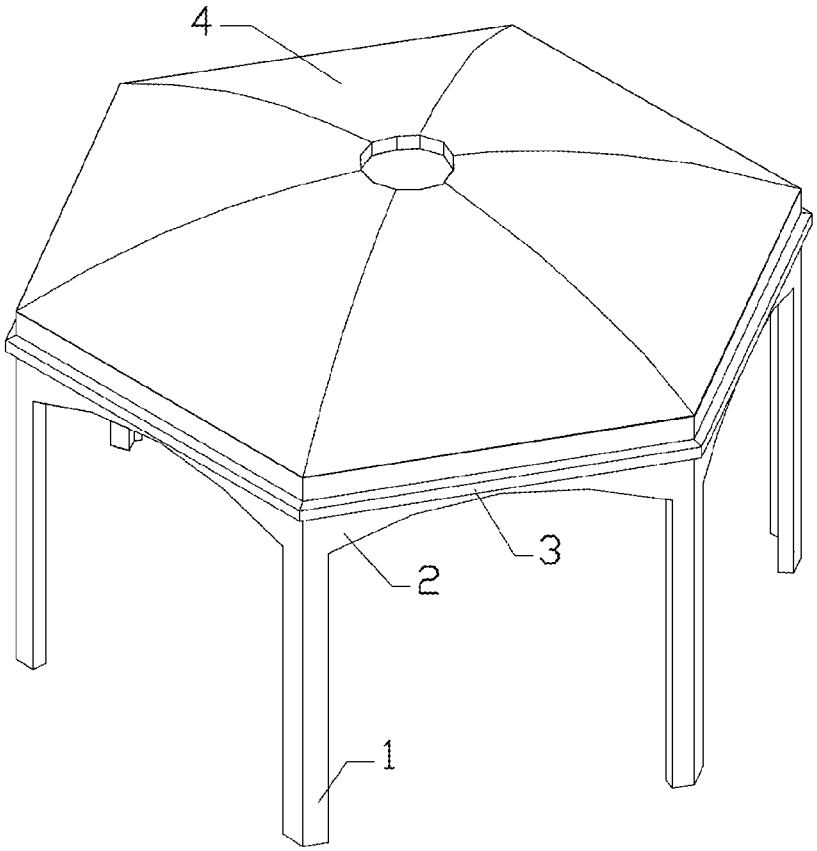

All designs, such as architectonic and structural design, shall be done according to the geometric characteristics which are described below;

Referring to FIG. 1 the reinforced concrete hexahedral module comprises six columns 1, a continuous beam 2, a corbel 3 and a hexagonal roof 4.

Referring to FIGS. 1,2,3,5,6,7 and 8 the reinforced concrete hexahedral module comprises six columns 1 arranged in a hexagonal distribution and placed each of them coincident in at least one straight line 10 of their top cross section with one of the six external edges of the hexagonal roof 11, these edges are also collinear with the external vertical projection 12 of the continuous beam's width therefore, they are contained in the plane of the external lateral face of the continuous beam, said beam is completely supported by the columns. This arrangement gives to the module a unique resistance against lateral forces and the requirements of the columns 1 gives flexibility in design because the cross section of said columns 1 can be different from one to another giving flexibility at the moment of the architectonic design. The column's steel reinforcement 9 shall be designed by a professional engineer.

Referring to FIGS. 1,2,3,5 and 8 the reinforced concrete hexahedral module comprises a continuous beam 2 with rectangular cross section and variable depth which encloses the six columns 1 in six spans and links them to the hexagonal roof 4. The external lateral face of the continuous beam 2 has a corbel 3 in all its length as is best shown in FIGS. 1 and 8, which act as a support for the building's roof and/or attachments therefore, it can support other structural members which bear in said corbel 3; With this feature there is more flexibility at the moment of combining the traditional construction with this invention. The continuous beam's steel reinforcement 13 and the corbel's steel reinforcement 14 shall be designed by a professional engineer.

Referring to FIGS. 1,2,3,4,5,8 and 9 the reinforced concrete hexahedral module comprises a hexagonal roof 4 which is best shown in FIGS. 1, 4 and 9 composed of six equal segments of curved slabs with a single curvature along the center line 6 of each segment and each of them trimmed as an equilateral triangle (viewed from top) where the center line 6 is one bisector of the triangle and has a circular cut with a given radius drawn on the vertex within said bisector, arranged in a circular pattern in said vertex (point). Given these geometries the reinforced concrete hexahedral module is viewed from top as a hexagon with a circular hole in the center and viewed from whichever of the six sides as a dome with a horizontal trim on top. These geometric characteristics allow a way to drain water in all directions, the hole on top can be used for architectonic purposes however, the module could support load in the perimeter of the hole. The hexagonal roofs steel reinforcement 15 shall be designed by a professional engineer.

Once all designs are finished, the formwork could be prepared and fixed over a slab or foundation, after this, the steel reinforcement is put on place and fixed to the formwork. Pipes and other fixtures embedded inside of the reinforced concrete hexahedral module should not modify the structural behavior and must be approved by the engineer before the cast begins, all the procedures involving the fabrication of this invention must follow the codes adopted by the professional engineers regarding principles, design and practice for reinforced concrete structures.

Once the concrete is cured the rebar can be tensioned by removing the formwork, all attachments required by the project can be fixed now to the hardened concrete however, drill holes, trims and any other changes that might cause structural problems to the reinforced concrete hexahedral module shall be approved only after a structural analysis done by the engineer.

Referring to FIG. 9 a finished house is shown, built with five reinforced concrete hexahedral module as the principal element in its construction, where typical construction elements and materials could be used for the construction of the house.

The invention claimed is:

1. A monolithic reinforced concrete piece for the construction of buildings comprising: six columns, a continuous beam having external faces, a corbel and a hexagonal roof having external edges, the piece is characterized by having the columns arranged in a hexagonal distribution, the continuous beam supported by the columns making six spans and forming a hexagonal perimeter when viewed from above, the corbel fixed along the external face of the beam, and the roof having a center which has a hexagonal shape with a circular hole in the center when viewed from above and curved when viewed from a side, which rest on the continuous beam.

2. A monolithic reinforced concrete piece according to claim 1, wherein the columns are arranged in a hexagonal distribution and placed each of them coincident in at least one straight line of their top cross section with one of the six external edges of the hexagonal roof, each of said columns having a four sided cross section or a six sided cross section and having at least one lateral face coplanar with one of the six external faces of the beam.

3. A monolithic reinforced concrete piece according to claim 1, wherein the continuous beam having rectangular cross section and variable depth which encloses the columns on top where the columns and the hexagonal roof are united, said continuous beam having a deepest cross section close to the columns and a shallow cross section at a midspan, supports the entire hexagonal roof and has the corbel fixed on the external face as a bearing support for another structural element in an entire length of the beam, said beam changing direction six times at the columns making six spans until the beam ends where it began.

4. A monolithic reinforced concrete piece according to claim 1, wherein the monolithic reinforced concrete piece has pipes inside and the pipes are used for all kinds of installation such as electrical conduits, plumbing, air conditioning ducts and others.

* * * * *